US005460588A

United States Patent [19]

Tate

[11] Patent Number: 5,460,588

[45] Date of Patent: Oct. 24, 1995

[54] ANTI-TIPPING DEVICE FOR A WEIGHT LIFTING BENCH SADDLE

[75] Inventor: Glenn P. Tate, 38015 Sarnette, Clinton Township, Macomb County, Mich. 48036

[73] Assignees: Glenn P. Tate; Peter D. Keefe, both of Clinton Township, Macomb County, Mich.

[21] Appl. No.: 230,313

[22] Filed: Apr. 20, 1994

[51] Int. Cl.[6] ..... A63B 21/078; A63B 21/00

[52] U.S. Cl. ..... 482/104; 482/106

[58] Field of Search ..... 482/16, 17, 34, 482/38, 104–108, 148, 142; 248/49, 65, 340, 219.2, 219.4; 211/60.1, 70.2; 294/17, 19.1, 19.3, 23.5, 24, 26; 124/91; 52/301; D21/191, 196, 197; 114/221 R; 403/384, 399

[56] References Cited

U.S. PATENT DOCUMENTS

| | | | |
|---|---|---|---|
| 179,127 | 6/1876 | Norcross | 294/26 |
| 2,550,770 | 5/1951 | Calemmo | 114/221 R |
| 2,562,794 | 7/1951 | Kalish | 294/24 |
| 2,702,910 | 3/1955 | Ake | 114/221 R |
| 3,843,981 | 10/1974 | Verest | 294/24 |
| 4,256,301 | 3/1981 | Goyette . | |
| 4,369,966 | 1/1983 | Silberman et al. . | |
| 4,412,678 | 11/1983 | Baynes . | |
| 5,083,813 | 1/1992 | Adkins | 248/340 |

FOREIGN PATENT DOCUMENTS

| | | | |
|---|---|---|---|
| 3546203 | 7/1987 | Germany | 482/104 |
| 3744449 | 7/1989 | Germany | 482/104 |
| 3812163 | 10/1989 | Germany | 482/104 |
| 1443892 | 12/1988 | U.S.S.R. | 482/104 |

OTHER PUBLICATIONS

Weightlifting Bench Product, Model WB0535 "Legacy" of Jack Lalanne Co. of Florida N.Y. 10921, Dated about 1992.

Letter of Denise Lott of Profitness Products, Inc. Dated Nov. 22, 1994.

Marcy 1974 Catalog p. 45, Extra–Heavy Squat Rack–Supine Press Bench Combination.

Marcy 1974 Catalog, p. 45, The "Nonpareil" Supine Press Bench, model No. 1910.

*Primary Examiner*—Richard J. Apley
*Assistant Examiner*—Victor K. Hwang
*Attorney, Agent, or Firm*—Peter D. Keefe

[57] ABSTRACT

An anti-tipping device for the saddles of weight lifting benches for preventing accidental tipping of barbells with respect to the saddles, wherein an abutment is provided at the rear stem of each saddle of a weight lifting bench. The anti-tipping device has a guide surface having increasing inclination toward the base of the saddle and terminates in a concave surface spaced from the base on the order of at least the diameter of the bar, and having a radius of curvature at least that of the bar. The anti-tipping device is dimensioned to occlude less than half the distance between the front and rear stems of each saddle, so that the saddles will operate in a completely conventional manner in terms of selectively receiving the bar of barbells when the bar is kept adjacent the front stem, but interferingly abuts the bar when the bar is adjacent the rear stem, so that the barbell is prevented from tipping no matter what the weight disparity may be with respect to the two ends of the bar. In one variation of the anti-tipping device according to the present invention, the saddles are manufactured therewith. In another variation of the anti-tipping device according to the present invention, conventional saddles are retrofitted therewith.

9 Claims, 2 Drawing Sheets

ANTI-TIPPING DEVICE FOR A WEIGHT LIFTING BENCH SADDLE

BACKGROUND OF THE INVENTION

1. Field of the invention

The present invention relates to benches used by weight lifters during weight training exercises, and more particularly to the saddles provided therewith for restably receiving barbells. Still more particularly, the present invention is related to saddles of the aforesaid class which are provided with a safety structure for preventing accidental tipping of the barbell with respect to the saddles during weight adjustment thereof.

2. Description of the Prior Art

Weight lifting benches provide a raised platform seat on which the weight lifter can sit or recline during his or her weight training. Barbells used for weight training employ a bar which has connected on each end thereof one or more replaceable disc shaped weights. A sleeve, usually of plastic, is sometimes located between the weights, which serves as a handhold surface for the weightlifter; accordingly, when referring to the bar hereinafter, it is intended that the sleeve be included as an optional feature of the bar. The weight lifting bench further provides for restable receiving of the bar, which is particularly useful during pressing routines. For this purpose, an upright is provided on each side of the bench, each upright terminating in a saddle. Each saddle is of a general U-shape for safely receiving the bar when the weight lifter places the elongated bar thereupon. Each saddle is characterized by a horizontally disposed base for restably supporting the bar which is interconnected with a pair of upstanding, mutually spaced stems that serve to prevent the bar from rolling off the base. Customarily, a front located stem is shorter than its opposing rear located stem, as this serves to guidably aid the weight lifter to place the bar of heavily weighted barbells into the saddles.

Frequently, weight lifters will change weights on the bar. This is a task that is inconveniently performed with the weights resting on the floor, but very conveniently performed when the bar is resting in the saddles. However, as weights are being adjusted, a problem arises when the weights of one side of the bar no longer weightably match the weights on the other side of the bar. This unbalance can result in the elongated bar tipping out of one or both of the saddles, which can potentially cause damage or injury.

U.S. Pat. No. 4,256,301 to Goyette, dated Mar. 17, 1981, discloses a weight lifting bench having a pair of posts, each of which having a V-shaped support for the bar of a barbell. A safety clamp is provided at each of the V-shaped supports, wherein a user manually slides a slidable member over the V-shaped support when the bar is resident therein, and a spring detent serves to prevent the slidable member from moving. Whereas this safety feature is workable for post-type uprights, conventional weight lifting bench uprights are pipe-like, so that this type of safety clamp is not adaptable for use therewith. Further, this safety feature must be manually set and manually released, which is both time consuming and involves the potential for trouble if a weight lifter forgets to set it or release it.

Accordingly, what is needed is a simple, effective, reliable and passive safety structure for weight lifting benches for preventing accidental tipping of barbells.

SUMMARY OF THE INVENTION

The present invention is a simple, effective, reliable and passive anti-tipping device for the saddles of weight lifting benches for preventing accidental tipping of barbells with respect to the saddles.

The anti-tipping device according to the present invention is an abutment provided at the rear stem of each saddle of a weight lifting bench. The anti-tipping device has a guide surface having increasing inclination toward the base of the saddle and terminates in a concave surface spaced from the base on the order of at least the diameter of the bar (inclusive of an optional sleeve, if present), and having a radius of curvature at least that of the bar (again, inclusive of an optional sleeve, if present). The anti-tipping device is dimensioned to occlude less than half the distance between the front and rear stems of each saddle, so that the saddles operate in a completely conventional manner in terms of selectively receiving the bar of barbells when the bar is kept adjacent the front stem, but interferingly abuts the bar when the bar is adjacent the rear stem, so that the barbell is prevented from tipping no matter what the weight disparity may be with respect to the two ends of the bar.

In one variation of the anti-tipping device according to the present invention, the saddles are manufactured therewith. In another variation of the anti-tipping device according to the present invention, conventional saddles are retrofitted therewith.

Accordingly, it is an object of the present invention to provide a passively operating anti-tipping device for saddles of a weight lifting bench to thereby prevent accidental tipping of a barbell placed thereupon.

It is an additional object of the present invention to provide an anti-tipping device for the saddles of a weight lifting bench which passively prevents the bar of a barbell from tipping, wherein the saddles operate in a conventional manner with respect to selectively receiving the bar of a barbell.

It is another object of the present invention to provide an anti-tipping device for the saddles of a weight lifting bench which passively prevents the bar of a barbell from tipping, wherein the saddles operate in a conventional manner with respect to selectively receiving the bar of a barbell, and wherein the anti-tipping device is retrofitted to conventional saddles.

These, and additional objects, advantages, features and benefits of the present invention will become apparent from the following specification.

DETAILED DESCRIPTION OF THE PREFERRED EMBODIMENT

Figure 1:
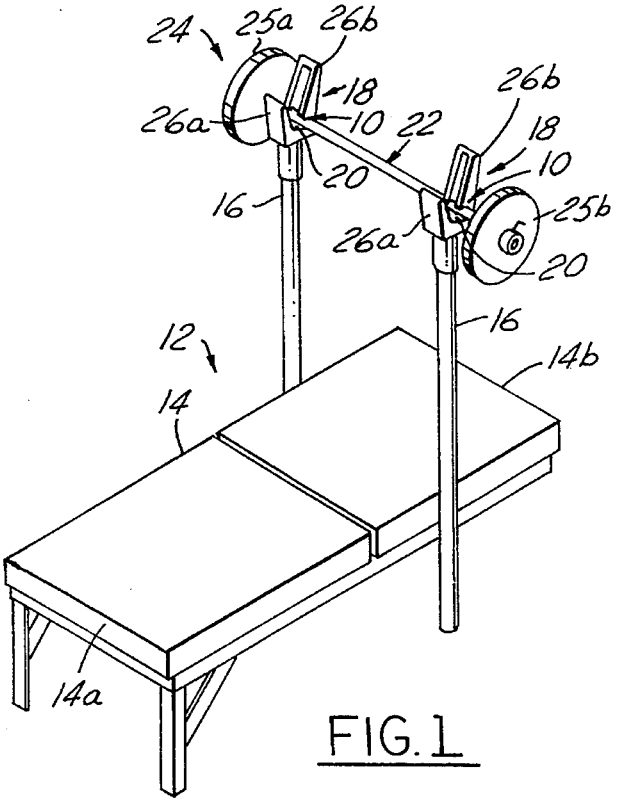
FIG. 1 is a perspective view of the anti-tipping device according to the present invention, shown in operation with a weight lifting bench and a barbell.
Figure 2:
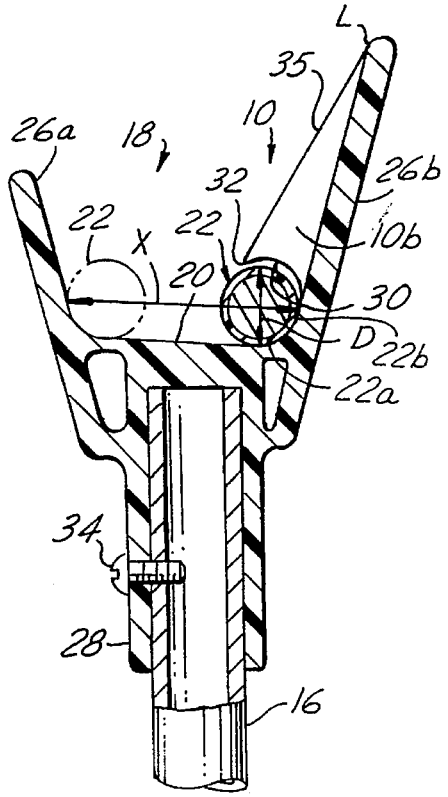
FIG. 2 is a partly sectional side view of a saddle equipped with the anti-tipping device according to the present invention.
Figure 3:
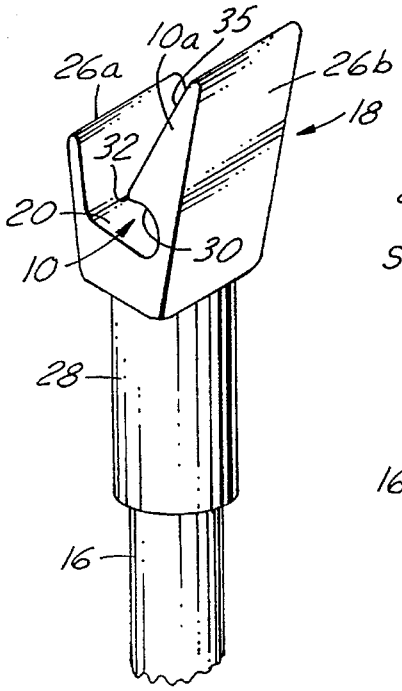
FIG. 3 is a perspective view of a weight lifting bench upright having a saddle equipped with the anti-tipping device according to the present invention.
Figure 5:
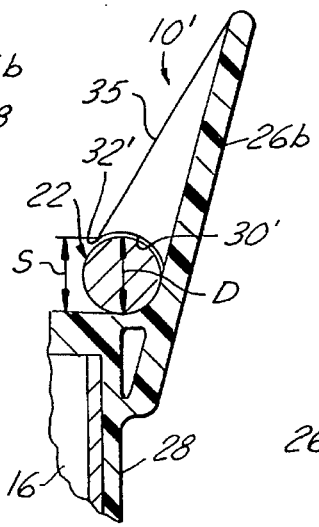
FIG. 5 is a partly broken-away, partly sectional side view of a weight lifting bench upright having a saddle equipped with an anti-tipping device structured to provide a snapping fit with respect to the bar of a barbell.
Figure 4:
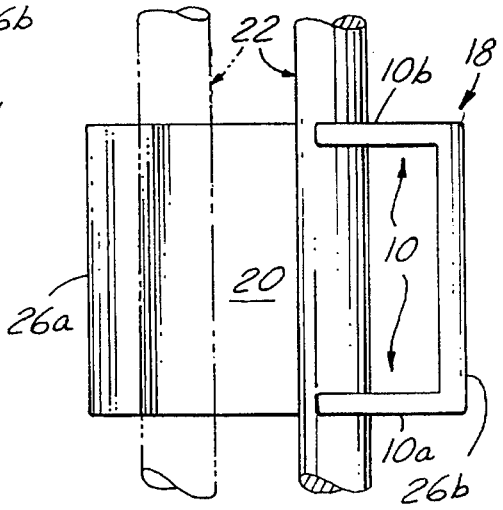
FIG. 4, is a plan view of a saddle equipped with the anti-tipping device according to the present invention, shown operatively with respect to the bar of a barbell.

Referring now to the Drawing, FIG. 1 generally shows the anti-tipping device 10 and its intended environment of use. A weight lifting bench 12 is provided with a raised platform seat 14 having a front end 14*a* and a rear end 14*b*. Near the rear end 14*b* of the platform seat 14 and at either side thereof is an upright 16. Each upright 16 terminates in a saddle 18. Each saddle 18 is defined by a base 20 for restably supporting the bar 22 of a barbell 24, and by a front stem 26*a* and a rear stem 26*b* for preventing the bar from accidentally rolling off the base. The bar 22 of the barbell 24 carries one or more disc shaped weights 25*a*, 25*b* at each end thereof. As shown in FIG. 2, the bar 22 includes an elongated rod 22*a* and, as an option, a sleeve 22*b* (note that FIGS. 1, 4 and 5 depict a bar 22 without a sleeve). The rear stem 26*b* is ordinarily taller than the front stem 26*a*, and the front and rear stems may be perpendicular with respect to the base 20, or may be at an angle thereto, such as the obtuse angle shown. The rear stem 26*b* is provided with the anti-tipping device 10, wherein the anti-tipping device occludes a portion of the space between the front and rear stems 26*a*, 26*b*. When the bar 22 is adjacent the rear stem 26*b*, the anti-tipping device interferingly abuts the bar to thereby prevent it from tipping; however, when the bar is adjacent the front stem 26*a*, the bar is free to be removed from or received into the saddles 18.

The structure and function of the anti-tipping device according to the present invention will now be detailed with greater specificity, first with reference to FIGS. 1 through 5 which depict a first variation of the anti-tipping device 10 wherein the saddle 18 is of a plastic construction integrated with each of the saddles.

The saddle 18 is provided with a sleeve 28 for mountably receiving thereinto a respective upright 16. As depicted in FIG. 2, the sleeve 28 is fixedly connected to the upright, such as by a threaded fastener 34, so that it cannot be detached from, or rotated with respect to, the upright 16. The front stem 26*a* is separated from the rear stem 26*b* by a preset distance X as measured adjacent the base 20. The bar 22 has a diameter D (the diameter D includes the optional sleeve 22*b* when it is present, as shown in FIG. 2), the exact dimension of which may vary with a particular brand of barbell bar.

The rear stem 26*b* is provided with the anti-tipping device 10. The anti-tipping device 10 is depicted by way of example in FIGS. 1 through 5 having a left anti-tipping member 10*a* and a right anti-tipping member 10*b*. Alternatively, there could be a single anti-tipping member which may or may not extend entirely transversely across the rear stem 26*b*, or there could be any other number of anti-tipping members. Each anti-tipping member 10*a*, 10*b* provides an abutment surface 30 which occludes a portion of the space between the front and rear stems 26*a*, 26*b*. In this regard, the abutment surface 30 extends outwardly from a front stem facing side of the rear stem 26*b*toward the front stem 26*a* a distance which is less than half the preset distance X, and preferably much less than half the preset distance X.

Preferably, the abutment surface 30 is concavely shaped, having a radius of curvature at least as large as the curvature of the bar 22 to thereby abuttably seat the bar thereinto as an aid in trapping the bar at the abutting surface when tipping thereof is at its earliest stage. Each anti-tipping member 10*a*, 10*b* has a guide surface 35 which is inclined with respect to the rear stem 26*b*. The incline of the guide surface 35 is defined by the guide surface being closest to the rear stem 26*b* at a location L preferably near the top of the rear stem and by being farthest from the rear stem at a tip 32. This inclination of the guide surface 35 serves to guidably interact with the bar 22 during placement thereof into the saddle 18, but interfering abutment at the abutment surface 30 occurs when the bar is adjacent the rear stem 26*b* while resident in the saddle 18.

Because the anti-tipping members extend less than half the preset distance X from the rear stem 26*b* toward the front stem 26*a*, the bar 22 is free to be removed from the saddle 18 provided the bar is substantially adjacent the front stem 26*a*. However, when the bar 22 is placed substantially adjacent the rear stem 26*b*, the bar is subjected to occlusion of the anti-tipping device 10. Preferably, the base 20 has a gentle slope downwardly off horizontal from the front stem 26*a* toward the rear stem 26*b*, so that the bar 22 has a natural tendency to roll into occlusion by the anti-tipping device 10.

As depicted in FIGS. 1 through 4, the tip 32 of the abutting surface 30 is spaced from the base 20 at least a distance equal to the diameter D of the bar 22. Further, the abutting surface is also spaced from the base 20 so as to allow the bar 22 to roll thereunder and be thereupon trapped by the abutting surface when the bar begins to tip. However, as shown in FIG. 5, the tip 32' may be a little closer to the base 20 as defined by separation distance S, than a distance equal to the diameter D of the bar 22, whereupon the bar requires a small push (toward the rear stem 26*b*) to thereupon snappingly force it into placement directly under the abutting surface 30'. A small push in the opposite direction (toward the front stem 26*a*) frees the bar from the tip. This latter configuration has the advantage of the anti-tipping device 10' operating only when the user specifically wants it, and further when in use, the use is assured by the snapping engagement between the tip and the bar.

In operation, a weight lifter freely moves the bar of his or her barbells into or out of the saddles by keeping the bar in the vicinity of the front stem. When the user wishes to change weights, the bar is either rotated, naturally rotated on a slope, or snappingly pushed, into occlusion by the anti-tipping device, which abuttably prevents the barbell from tipping no matter how the weights may be disparate between either end of the bar.

Figure 6:
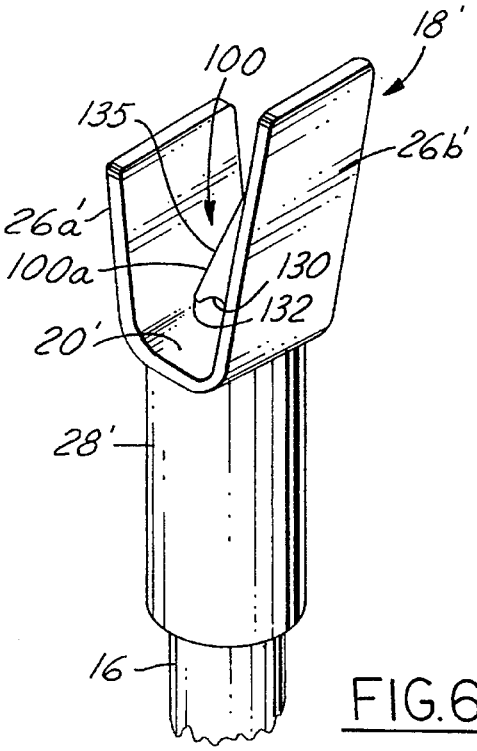
FIG. 6 is a perspective view of a weight lifting bench upright having a saddle equipped with a variation of the anti-tipping device according to the present invention.
Figure 7:
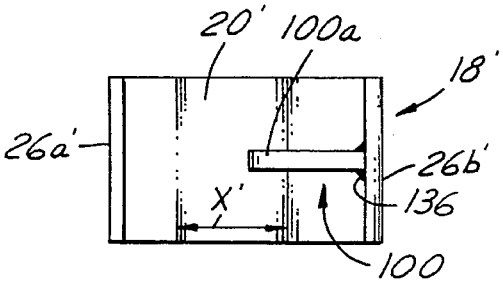
FIG. 7 is a plan view of a saddle equipped with the anti-tipping device depicted in FIG. 6.
Figure 8:
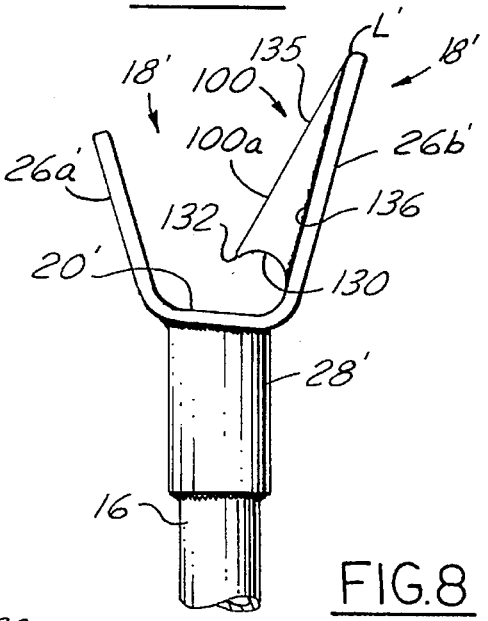
FIG. 8 is a side view of a saddle equipped with the anti-tipping device depicted in FIG. 6.

FIGS. 6 through 8 depict another variation of the present invention in the form of an anti-tipping device 100 which is of a metal construction integrated with each of the saddles.

Each saddle 18' is provided, by way of example, with a single anti-tipping member 100*a* which is connected by welding 136 to a medial location on the front stem facing side of the rear stem 26*b*'. The anti-tipping member 100*a* has a guide surface 135 which inclines with respect to the rear stem 26*b*' increasingly from a location L' adjacent the top end of the rear stem 26*b*' to a tip 132. An abutment surface 130 is provided which extends from the tip 132 to the rear stem 26*b*'. The abutment surface 130 is preferably concavely shaped, as discussed hereinabove. The tip 132 is spaced from the base 20' a distance at least equal to the diameter of a bar of a barbell, or a little less than the diameter of a bar in order to provide a snapping fit therebetween, as discussed hereinabove. The tip 132 is separated from the front stem 26*a*' by at least more than half the stem separation distance X'. Each saddle 18' is provided with a sleeve 28'. Operation is in accordance with the discussion hereinabove with respect to FIGS. 1 through 5.

Figure 9:
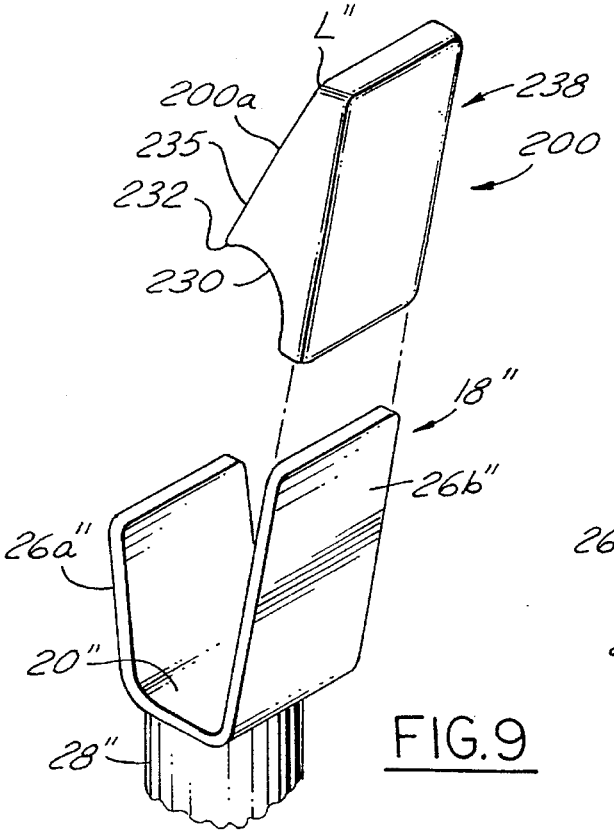
FIG. 9 is a perspective view of a conventional saddle about to be retrofitted with the anti-tipping device according to the present invention.
Figure 10:
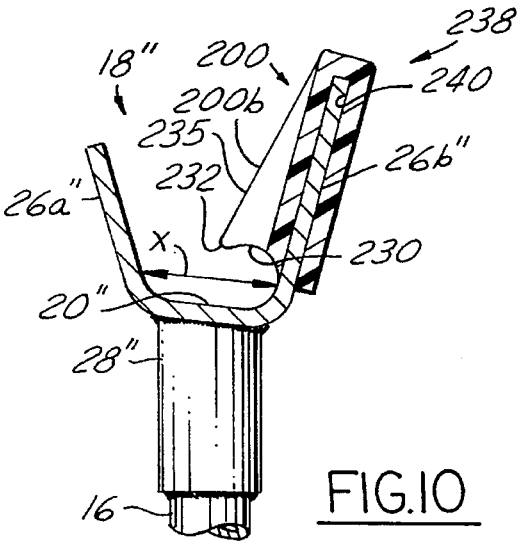
FIG. 10 is a partly sectional side view of a conventional saddle retrofitted with the anti-tipping device according to the present invention.

FIGS. 9 and 10 depict another variation of the present invention in the form of an anti-tipping device 200 which is structured to be retrofitted to an existing conventional rear stem 26*b*" of a saddle 18".

The anti-tipping device 200 includes a mounting member 238 having a slot 240, preferably being a blind slot, which is dimensioned to tightly receive thereinto the rear stem 26*b*" to thereby fixedly attach the mounting member to the saddle 18" by a non-slip frictional interrelationship. Alternatively for example, the blind slot 240 may be affixed to the rear stem 26*b*" by gluing or another fastener methodology. The anti-tipping device 200 further includes, a front stem 26*a*", a sleeve 28", and by way of example, left and right anti-tipping members 200*a*, 200*b* having a structure as generally described with respect to the anti-tipping device 10 shown in FIGS. 1 through 5, wherein each of the anti-tipping members 200*a*, 200*b* have guide surfaces 235 which incline with respect to the rear stem 26*b*" increasingly from a point L" toward the tip 232, whereat is formed an abutment surface 230 which extends therefrom toward the slot 240. Preferably, the abutment surface 230 is concavely shaped, as discussed hereinabove In operation, a user would forceably slide the rear stem 26*b*" into the slot 240. When employing a blind slot for the slot 240, in some cases the top end of the rear stem may contact the blind end of the slot and thereby define placement of the tip 232 with respect to the base 20". However, this may not be feasible for a particular length of rear stem, whereupon the user must select the placement of the tip 232 in relation to the base 20" as the rear stem is inserted into the blind slot to provide a free rolling distance for the bar 22 or a mutually snapping relationship therewith.

To those skilled in the art to which this invention appertains, the above described preferred embodiment may be subject to change or modification. For example, the anti-tipping device may be constructed of any suitable material, the materials discussed hereinabove being preferred examples. Also for example, while the bar of a barbell is discussed herein, any bar, such as a curling bar is contemplated within the present disclosure to be operable with respect to the anti-tipping device. For example further, the abutment surface need not be concavely shaped; it may, for example, be flat. Further, the tip may provide a snapping fit with respect to the bar by providing a nib thereat which faces toward the base. Such change or modification can be carried out without departing from the scope of the invention, which is intended to be limited only by the scope of the appended claims.

What is claimed is:

1. A pair of barbell supporting saddles for a weight lifting bench, each saddle of the pair of saddles being equipped with an anti-tipping device for a bar of a barbell, the bar selectively including a sleeve, the bar having a predetermined diameter, wherein the bar is selectively restable upon the pair of saddles, each saddle of the pair of saddles comprising:

a base;

means for connecting said base to a weight lifting bench;

a front stem connected with the base; and a rear stem connected with the base and spaced from the front stem a predetermined distance, said rear stem being provided with an anti-tipping device, said anti-tipping device comprising:

at least one anti-tipping member connected with said rear stem, said at least one anti-tipping member projecting from said rear stem toward said front stem a distance less than half said predetermined distance between said front and rear stems, each anti-tipping member comprising:

a guide surface having a first location and an opposite second location, said guide surface being inclinably oriented at an acute angle with respect to said rear stem as measured at said first location, wherein the angle locates said guide surface closest said rear stem at said first location guide surface that is farthest from said and locates said guide surface farthest from said rear stem at said second location, said second location defining a tip; wherein said guide surface is a single substantially planar surface connecting said first and second locations; and an abutment surface extending from said tip to said rear stem, said abutment surface being spaced from said base so that the bar is placeable between said abutment surface and said base;

wherein the bar is placeable into and out of each saddle when the bar is kept substantially adjacent said front stem thereof, but the bar interferingly abuts said abutment surface when the bar is substantially adjacent said rear stem of each saddle so as to prevent the bar from tipping off said saddles.

2. The saddle of claim 1, wherein said base is sloped relative to horizontal wherein said base adjacent said front stem is at a higher elevation than said base adjacent said rear stem.

3. The pair of saddles of claim 1, wherein said abutment surface is concavely shaped.

4. A weight lifting bench apparatus having a pair of barbell supporting saddles, each saddle of the pair of saddles being equipped with an anti-tipping device for a bar of a barbell, the bar selectively including a sleeve, the bar having a predetermined diameter, wherein the bar is selectively restable upon the pair of saddles, said weight lifting bench apparatus comprising:

platform seat means having a first side and a second side;

a first upright connected with said platform seat means and located at said first side thereof;

a second upright connected with said platform seat means and located at said second side thereof;

a pair of saddles, one saddle being connected respectively to each of said first and second uprights, each saddle comprising:

a base connected to a respective upright of said first and second uprights;

a front stem connected with said base; and a rear stem connected with said base and spaced from said front stem a predetermined distance, said rear stem being provided with an anti-tipping device, said anti-tipping device comprising:

at least one anti-tipping member connected with said rear stem, said at least one anti-tipping member projecting from said rear stem toward said front stem a distance less than half said predetermined distance between said front and rear stems, each anti-tipping member comprising:

a guide surface having a first location and an opposite second location, said guide surface being inclinably oriented at an acute angle with respect to said rear stem as measured at said first location, wherein the angle locates said guide surface closest said rear stem at said first location guide surface that is farthest from said and locates said guide surface farthest from said rear stem at said second location, said second location defining a tip; wherein said guide surface is a single substantially planar surface connecting said first and second locations; and an abutment surface extending from said tip to said rear stem, said abutment surface being spaced from said base so that the bar is placeable between said abutment surface and said base;

wherein the bar is place able into and out of each saddle when the bar is kept substantially adjacent said front stem thereof, but the bar interferingly abuts said abutment surface when the bar is substantially adjacent said rear stem of each saddle so as to prevent the bar from tipping off said saddles.

5. The the weight lifting bench apparatus of claim 4, wherein said base is sloped relative to horizontal wherein said base adjacent said front stem is at a higher elevation than said base adjacent said rear stem.

6. The weight lifting bench apparatus of claim 4, further comprising the bar; wherein said abutment surface is concavely shaped, said abutment surface having a first radius of curvature at least as large as a second radius of curvature defined by the diameter of the bar for seatably receiving the bar.

7. The weight lifting bench apparatus of claim 6, wherein said tip is structured and located with respect to said base so as to provide a spaced distance from said base slightly less than the diameter of the bar for providing a snapping fit relationship with respect to the bar as the bar is moved along said base from adjacent said front stem to adjacent said rear stem.

8. An anti-tipping device for connecting to a rear stem of a barbell supporting saddle of a weight lifting bench for preventing tipping of a bar of a barbell with respect to the saddle, the saddle being provided with a base, a front stem connected with the base and a rear stem connected with the base and spaced from the front stem a predetermined distance, said anti-tipping device comprising:

at least one anti-tipping member; and a connection member connected with said at least one anti-tipping member, said connection member having a slot end, said connection member further having a slot formed thereinside, said slot having an opening, said opening being formed in said slot end;

wherein each anti-tipping member comprises:

a guide surface having a first location and an opposite second location, said guide surface being inclinably oriented at an acute angle with respect to the slot as measured at said first location, wherein the angle locates said guide surface closest the slot at said first location and locates said guide surface farthest from the slot at said second location, said second location defining a tip; wherein said guide surface is a single substantially planar surface connecting said first and second locations; and an abutment surface extending from said tip to the slot end of said connection member;

whereby, when the rear stem of a weight lifting bench saddle is received in said slot, the bar is placeable into and out of the saddle when the bar is kept substantially adjacent the front stem thereof, but the bar interferingly abuts said abutment surface when the bar is substantially adjacent the rear stem of each saddle so as to prevent the bar from tipping off the saddle.

9. The anti-tipping device of claim 8, wherein said abutment surface is concavely shaped.

* * * * *